United States Patent [19]

Dobson

[11] Patent Number: 5,066,014

[45] Date of Patent: Nov. 19, 1991

[54] SIDEWINDER AMUSEMENT GAME

[75] Inventor: Michael J. Dobson, Mississauga, Canada

[73] Assignee: Bob's Space Racers, Inc., Daytona Beach, Fla.

[21] Appl. No.: 697,886

[22] Filed: May 9, 1991

Related U.S. Application Data

[63] Continuation-in-part of Ser. No. 617,626, Nov. 26, 1990.

[51] Int. Cl.[5] ..... A63F 7/02; A63F 07/28; A63F 07/38

[52] U.S. Cl. ..... 273/110; 273/115; 273/118 R; 273/120 R; 273/123 R; 273/108; 273/113

[58] Field of Search ..... 273/108, 109, 110, 113, 273/115, 118 R, 118 A, 120 R, 120 A, 121 R, 121 A, 123 R, 123 A, 124 R, 124 A, 127 R, 127 B, 127 C

[56] References Cited

U.S. PATENT DOCUMENTS

| | | | |
|---|---|---|---|
| 966,091 | 8/1910 | Heinig et al. | 273/110 |
| 3,479,033 | 11/1969 | Crisafulli | 273/113 |
| 3,549,149 | 12/1970 | Dreyer | 273/110 |
| 3,554,553 | 1/1971 | Hayashi | 273/110 |
| 3,712,620 | 1/1973 | Goldfarb et al. | 273/120 R |
| 3,815,917 | 6/1974 | Brown | 273/110 |
| 4,055,341 | 10/1977 | Martinez | 273/86 C |
| 4,094,507 | 6/1978 | Kauffmann | 273/110 |
| 4,143,875 | 3/1979 | Browning et al. | 273/101 |
| 4,258,918 | 3/1981 | Nishimiya | 273/110 |

FOREIGN PATENT DOCUMENTS

| | | | |
|---|---|---|---|
| 2016933A | 9/1979 | United Kingdom | 273/110 |

*Primary Examiner*—Edward M. Coven
*Assistant Examiner*—Raleigh W. Chiu
*Attorney, Agent, or Firm*—Herbert W. Larson

[57] ABSTRACT

A carnival or amusement park game in which a player is challenged to keep a rolling ball to its objective descending, planar, zig-zag path by manipulating the rotation of the plane of the path. The game may be further enhanced by providing rotational steering alternatives, providing for coin operation, or by providing a device to record or signal the event of a successful play.

20 Claims, 8 Drawing Sheets

SIDEWINDER AMUSEMENT GAME

PRIOR APPLICATION

This application is a continuation-in-part of my application Ser. No. 07/617,626, filed Nov. 26, 1990, which is based on disclosure document number 263,615, filed Sept. 27, 1990.

BACKGROUND OF THE INVENTION

The invention relates to amusement games, particularly those which require the hand-eye coordination of a participant in controlling the plane for a rolling ball.

Carnivals and amusement parks require games which are challenging to participants, are easy to learn and comprehend, offer a realistic possibility of success, and may be quickly and easily administered by carnival vendor personnel. Frequently, such games involve hitting targets with a thrown object (such as ring tossing games), knocking down targets (such as milk jugs) with a thrown ball, or tossing a ball through a small opening. Additionally, such games often include race type formats where a participant steers some form of object through an obstacle or race course. Other games are directed towards balancing or timing skills.

Many such games provide a controllably sloping planar surface and require the participant to manipulate the planar surface in such a way as to cause a rolling object to traverse a particular course and reach an objective. For instance, U.S. Pat. No. 4,094,507, issued to Kauffman on June 13, 1978, and U.S. Pat. No. 4,258,918, issued to Nishimiva on Mar. 31, 1981, teach bi-axle rotating planes upon which mazes have been provided. By rotating either, or both, axes of the planes, a player can control the movement of a rolling ball on the plane. The object of these games is to manipulate the ball around various maze paths, avoid obstacles, and reach a destination. The games may be quite time consuming as a player may balance the ball at a resting point or cause it to move slowly through the mazes.

U.S. Pat. No. 3,479,033, issued to Crisafulli, et al. Nov. 18, 1969, and U.S. Pat. No. 3,815,917, issued to Brown, June 11, 1974, teach rotating plane games in which players compete to move balls toward opposing objectives. Two well-matched opponents could keep the game going for some period of time.

A carnival or amusement park vendor must have a game which is easy to understand so that players will not be afraid to come forward and take a chance. The game should also be quick to play so that a single player cannot keep the playing facility occupied for too long a period with a single ticket or fee. It is also helpful to provide such a vendor with a game which can be played with little or no attendant supervision.

The games which presently capitalize the controlled plane ball-rolling skill according to the present art are both time consuming and somewhat difficult to learn. Consequently, they are not well suited for the carnival or the amusement park environment. It would be useful to devise such a game which capitalizes on these skills and could also be profitably applied to the amusement park or carnival array of games.

SUMMARY OF THE INVENTION

The inventor has devised such a game which is simple to comprehend, easy to administer, and quickly played. It generally comprises a path which further comprises a series of zig-zag curves. A ball is launched from an upper point of the beginning and is free to travel down along the curved zig-zag path to an objective target point, if the participant is able to successfully manipulate the curved zig-zag path by alternately rotating it.

In order to provide the participant with a reasonable opportunity to develop the skill necessary to manipulate the ball along the path, the first portion of the curved zig-zag path is adapted with rails along either side in order to keep the ball on the path for a period of time enabling the participant to become familiar with the mechanics of the game. Once the ball passes the side rail portion of the path, the participant must rely upon his or her own skills in order to keep the ball on the path long enough to reach the objective.

The game may be further enhanced by providing a gearing mechanism to operate in conjunction with the control means for manipulation of the path in order to reverse the direction of rotation between the participant's controls and the path itself or to change the ratio of rotation between the participant's rotation and the rotation of the surface itself.

The curved planar zig-zag path is oriented with an upper point of beginning and a lower objective point. Accordingly, the ball will automatically roll down the slope of the curved, zig-zag path generally towards the destination. While the player may laterally rotate the plane of the game in either direction in order to try to keep the ball on the path, the player is without means to prevent the force of gravity from ultimately drawing the ball either along the path to the objective or to fall off the path. Consequently, each play of the game is limited in time and cannot be extended by the player. This makes the game ideally suited for a carnival or amusement park.

Finally, the game may be enhanced by housing it in a cabinet which permits its operation with little or no supervision. This optional feature may be achieved by adapting the game with surfaces to automatically deliver the ball to the point of beginning after each play. Additional optional features could include a coin activation mechanism to permit a player to retrieve the ball without an attendant or a target sensor to sound or display a lighted signal upon a successful play of the game.

It is then an object of the invention to provide a simply taught and played ball-rolling game testing the hand-eye coordination of a participant.

It is a further object of the present invention to provide such a game which is suitable for use in an amusement park or carnival environment.

It is a further object of the present invention to provide such a game which may be adjusted in difficulty in order to keenly test the skills of the participant.

It is a further object of the present invention to provide such a game which is capable of automatic operation or operation with minimal attendant supervision.

Other features and advantages of the present invention will be apparent from the following description in which the preferred embodiments have been set forth in conjunction with the accompanying drawings.

BRIEF DESCRIPTION OF THE DRAWINGS

In describing the preferred embodiments of the invention reference will be made to the series of figures and drawings briefly described below.

DETAILED DESCRIPTION OF THE PREFERRED EMBODIMENT

Reference will now be made in detail to the present preferred embodiment of the invention, an example of which is illustrated in the accompanying drawings. While the invention will be described in connection with a preferred embodiment, it will be understood that it is not intended to limit the invention to that embodiment. On the contrary, it is intended to cover all alternatives, modification and equivalents as may be included within the spirit and scope of the invention defined in the appended claims.

Figure 1:
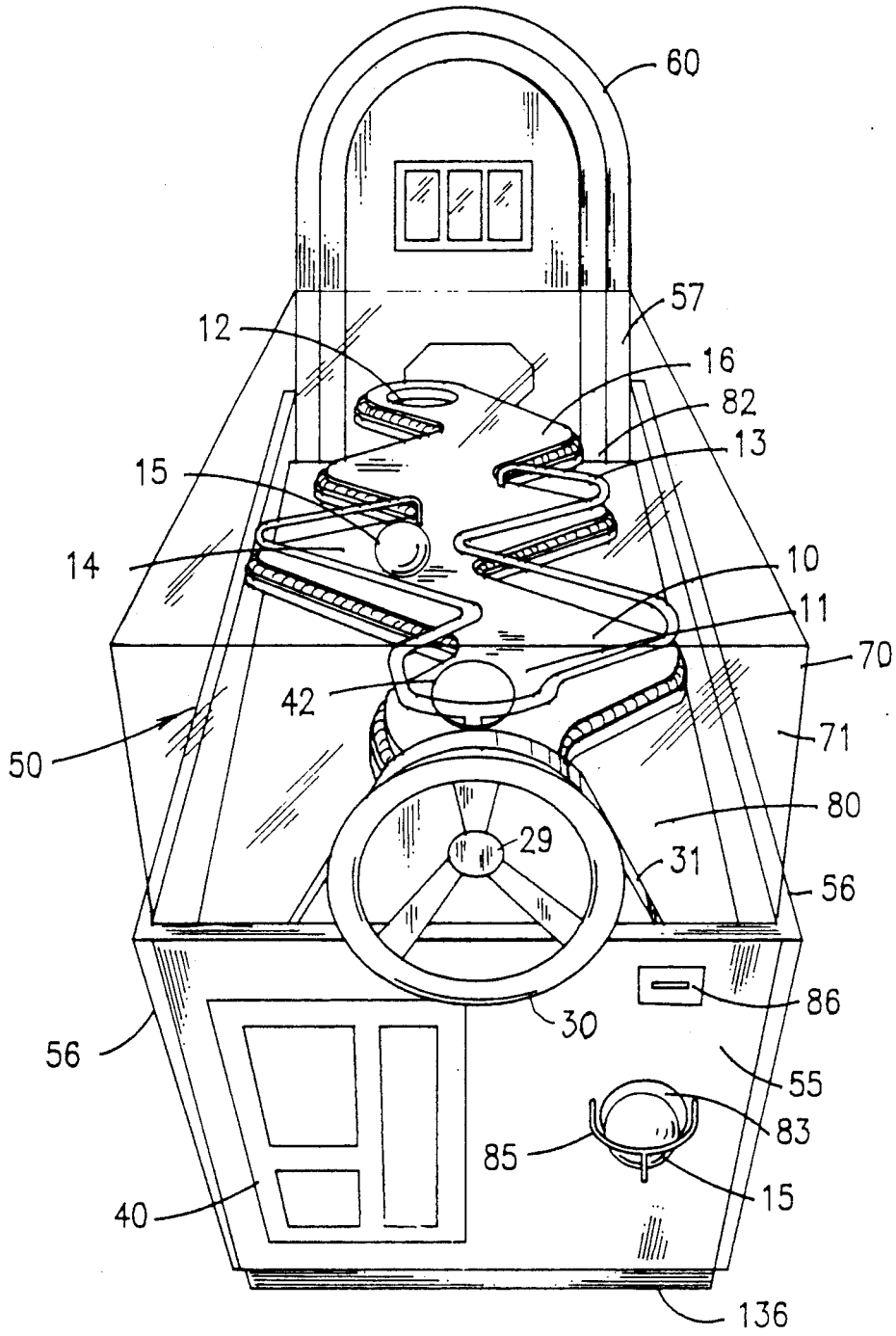
FIG. 1 is a perspective view of the apparatus depicting its major components housed in a cabinet.

Making reference first to FIG. 1, the overall game apparatus is depicted from the perspective of the participant. The curved zig-zag or serpentine path incorporated into table 10 has a front to rear slope and is mounted within a support structure 50 which comprises a front panel 55, side panels 56, a rear panel 57 and bottom support panel 80. A scoreboard 60 can be mounted on rear panel 57. A base member 136 sits flush with the ground or flooring supporting the structure 50.

At the top of the front panel 55 is provided a steering wheel mount or transmission housing 31 upon which a steering wheel 30 is mounted. Within the steering wheel mount 31, depicted in FIG. 5, is a set of two or more gears. Top gear 68 turns on upper shaft 20 and lower gear 69 turns on lower shaft 24. Additionally, there is an axle 53 depicted in FIGS. 3 and 4 which provides linkage between steering wheel 30 and the curved zig-zag path 10. While the preferred embodiment has been depicted with a steering wheel 30, any implement capable of effecting rotational motion, such as a radial handle or lever 22 shown in FIG. 2 can be employed.

The curved zig-zag path 10 has a point of beginning 11 near the steering wheel 30 and, at the other end or rear of the zig-zag path 10, an objective 12. A curved zig-zag path 10 is generally planar and slopes from the upper point of beginning 11 to the lower objective 12. The rail 13 is adapted to surround the zig-zag path from the point of beginning 11 down along the first portion 14 of the curved zig-zag path 10. A ball 15 placed at or near the point of beginning 11 will, as a result of the force of gravity roll down the path 10 generally towards the objective 12. While rolling along the first portion 14 of the path 10 the side rails 13 will keep the ball 15 on the path.

After the ball 15 has passed the first portion 14 of the path 10 it will enter the last portion 16 of the curved zig-zag path 10. At this point, the ball will leave the path 10 unless the participant (not depicted) can manipulate the rotation of the plane of the path 10 so as to prevent the ball 15 from rolling off of the path 10. The successful participant will be able to manipulate the rotation of the path 10 until the ball reaches the objective 12.

FIG. 1 also depicts the game enclosed in a clear cover cabinet 70. The cabinet 70, as depicted, has a front panel 71. The steering wheel 30 or lever 22 has a shaft 29 connecting through panel 71 for insertion into insert 26 or 27 respectively. A ball drop hole 42 is located in front panel 71 to drop ball 15 onto table 10.

The bottom support panel 80 connects the cabinet panels 55, 56 and 57. Strut 52 is mounted on a top surface of panel 80. This support panel 80 could (but need not) be sloped down from the rear panel 57 to the front panel 55 so that a ball 15 which falls off the curved path 10 rolls down to the front panel 55. By further adapting the support panel 80 with a channel 28 shown in FIG. 10 or a low point adjacent to the front panel 55, the ball 15 can be caused to roll to a designated point 83 along the front panel 55 which can be further adapted with a gate 85 for selectively retrieving the ball 15 through the front panel 55 at that point 83. Also located in front panel 55 is an optional ticket dispenser 40.

It should be noted that the principles of the invention do not require the use of any cabinet at all. In order to practice the game, it is only necessary to be able to mount a steering wheel 30 or control mechanism 22 in front of the path 10 and to pivotally support the rest of the path in a downward slope. Accordingly, the support or mounting structure could be dispensed with altogether or could, alternatively, be in any shape or configuration which properly orients and supports the path 10 and control means. Additionally, a single support structure could be built to house a series of such paths 10 side by side.

Additionally, the cabinet could be made in some manner other than with the substantially rectangular panels described and depicted herein. For instance, an elongated elliptical panel could be used (not depicted) with the planar path housed within the ellipse and the steering mechanism mounted at the oblong end proximate to the path point of beginning. Any form of housing which would accommodate supporting the inclined orientation of the path and permit the rotation of the path would be satisfactory and within the spirit and scope of the invention as hereafter claimed.

Figure 10:
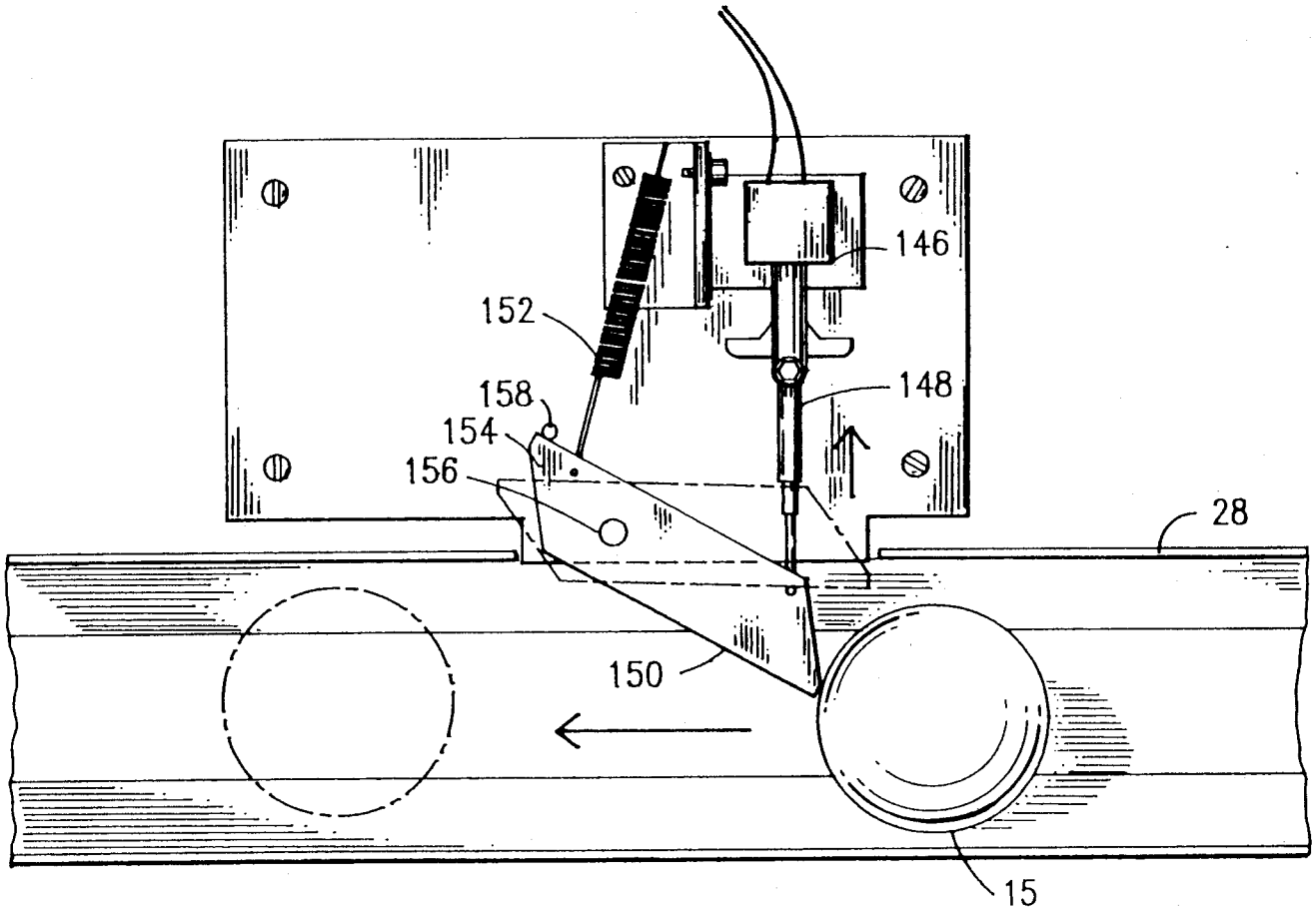
FIG. 10 is a top plan view of the ball release mechanism of the game.

It should also be noted that the game may be automated. By adapting the gate 85 to be controlled with a coin activation device 86 a player could obtain access to a ball 15 without the need for an attendant by depositing the appropriate coin, token, ticket, or bill for play. Once the ball 15 falls off of the path 10, the ball 15 will automatically return to the gate 85 for the next plays as a result of the slope of the support panel 80 and any channel built therein. A coin activation mechanism is shown in FIG. 10. Any such device capable of detecting the deposit of the correct combination of coins or tokens and energizing a relay would be satisfactory. This automatic feature is also presented as an optional enhancement of the game and is not necessary to make or practice a device incorporating the principles of the invention.

Figure 2:
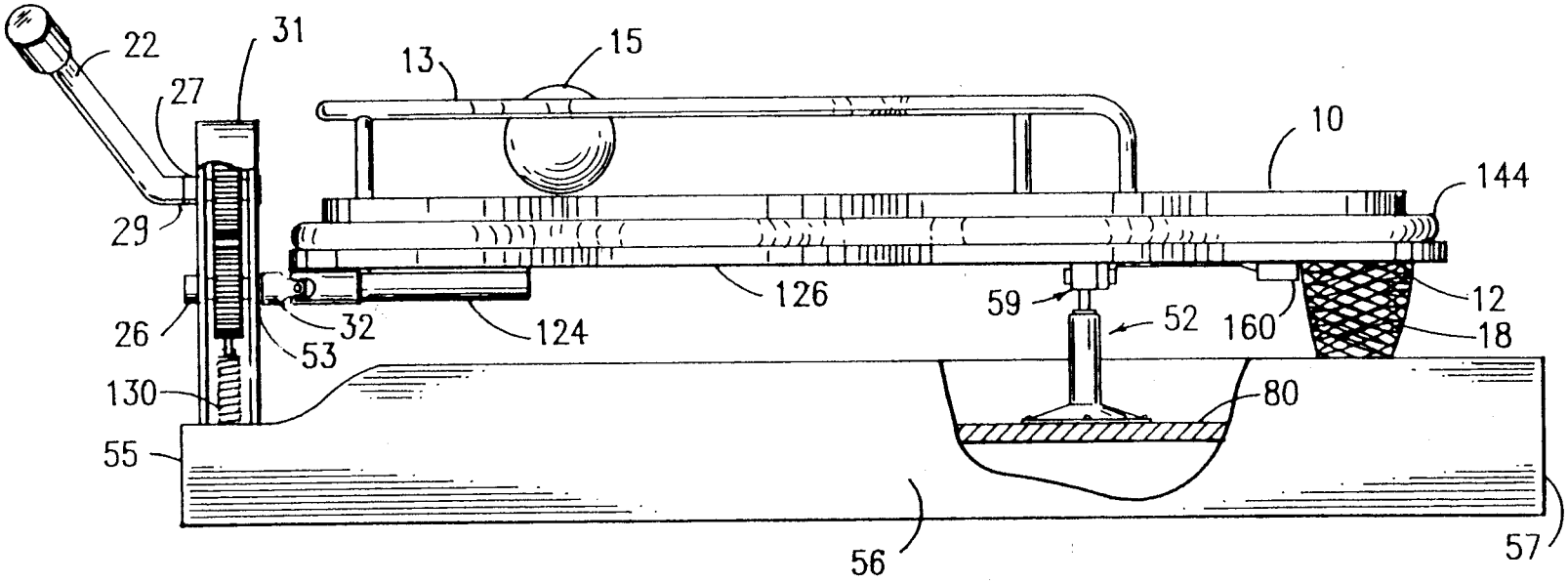
FIG. 2 is a side elevational view partially in section depicting the location of the gear and transmission mechanism and one of the mounting devices.
Figure 8:
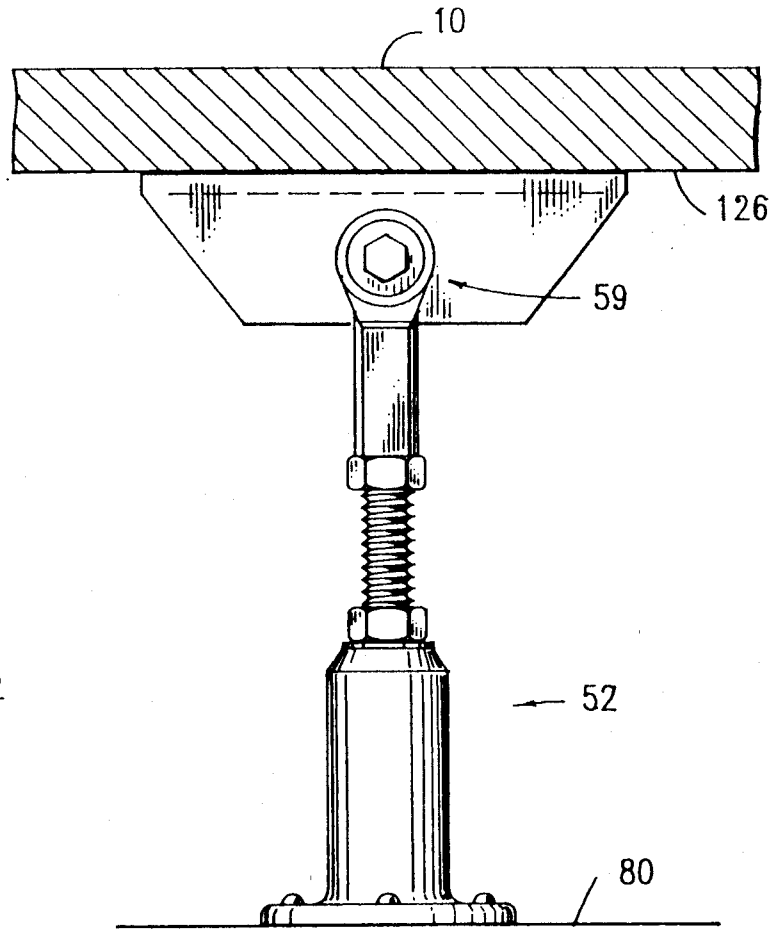
FIG. 8 is a rear elevational view of the support strut.
Figure 7:
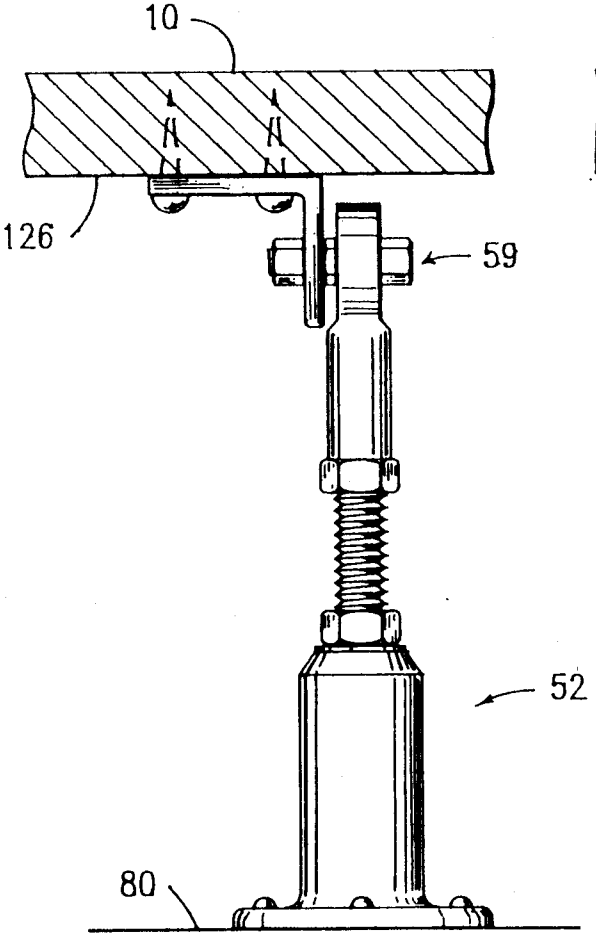
FIG. 7 is a side elevational view of the support strut.

Making reference now to FIG. 2, the relevant support structure of the path 10 can be seen. It is first noted that the curved zigzag path 10 from the side view is seen to be planar. It is also noted that the objective point 12, may, but need not, be adapted with a net 18 to catch a ball which has been successfully manipulated to the objective point. The curved zig-zag path 10 is supported by an axle rod 53 which is axially connected to shaft 24. At a point near the objective 12 a strut 52 supports the curved path 10. The strut 52 is further adapted with a freely pivoting mount 59 as seen in FIGS. 7–8, which permits the zig-zag path 10 to be rotated either clockwise or counter-clockwise. The axle rod 53 is in geared communication with the steering wheel 30. The steering wheel 30 can be used to manipulate the rotation of the curved path 10 in either a clockwise or counter-clockwise direction. Such rotation is in no way impeded by the pivoting mount 59.

Figure 9:
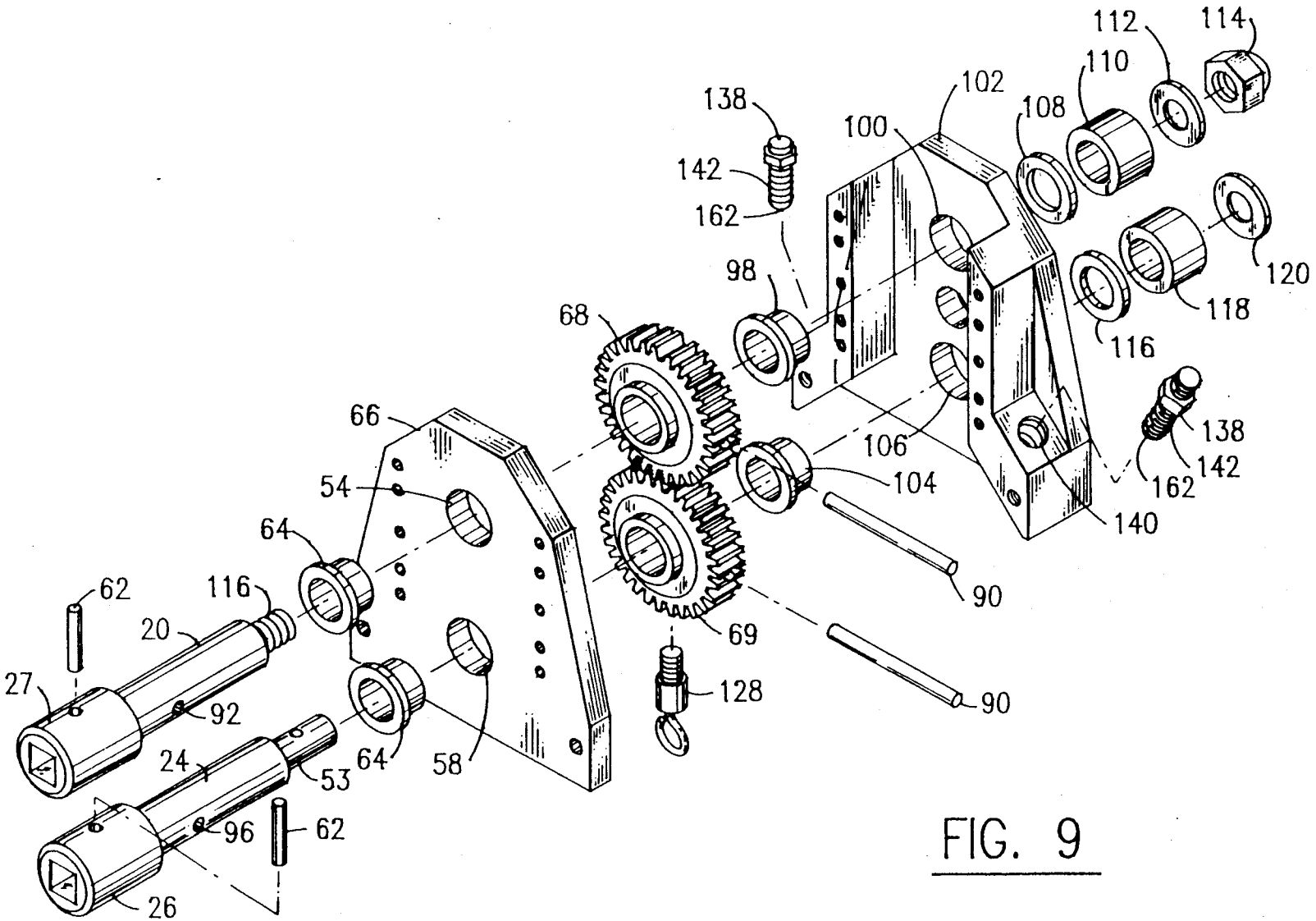
FIG. 9 is an exploded view of the steering shafts.

Referring to FIG. 9, the steering wheel shaft 29 can be inserted into either the insert 27 for upper shaft 20 or the insert 26 for lower shaft 24. A locked pin 62 locks the steering wheel shaft 29 in place within either insert 27 or 26. A bushing 64 is inserted into holes 54 and 58 in the front wall 66 of the transmission housing 31. Shaft 20 fits through the bushing 64 and hole 54 to engage top gear 68. Shaft 24 fits through the bushing 64 and hole 58 to engage bottom gear 69. A pin 90 locks the shaft 20 through hole 92 to gear 68 and another pin 90 locks the shaft 24 through hole 96 to gear 69. The axle 53 of shaft 24 engages the universal joint 32 and is held in place by pin 122.

Shaft 20 passes through bushing 98 and hole 100 in the back wall 102 of the transmission housing 31. In like manner, shaft 24 passes through bushing 104 and then through hole 106 in back wall 102. A bushing 108, a spacer 110, a washer 112 and acorn nut 114 terminate the threaded end 116 of shaft 20. Shaft 24 passes through bushing 116, spacer 118 and washer 120 before engaging the universal joint 32 with axle 53. Pin 122 holds the axle 53 in place in the universal joint 32. The universal joint 32 is connected to a plate 124 screwed to the bottom 126 of table 10.

If the steering wheel 30 is connected to lower shaft 24, then as the player turns the wheel 30 in a clockwise direction the table 10 tilts in a clockwise direction. To make the game more difficult the wheel 30 can be connected to upper shaft 20 so that as the player turns the wheel in a clockwise direction the board 10 tilts in a counterclockwise direction.

Figure 5:
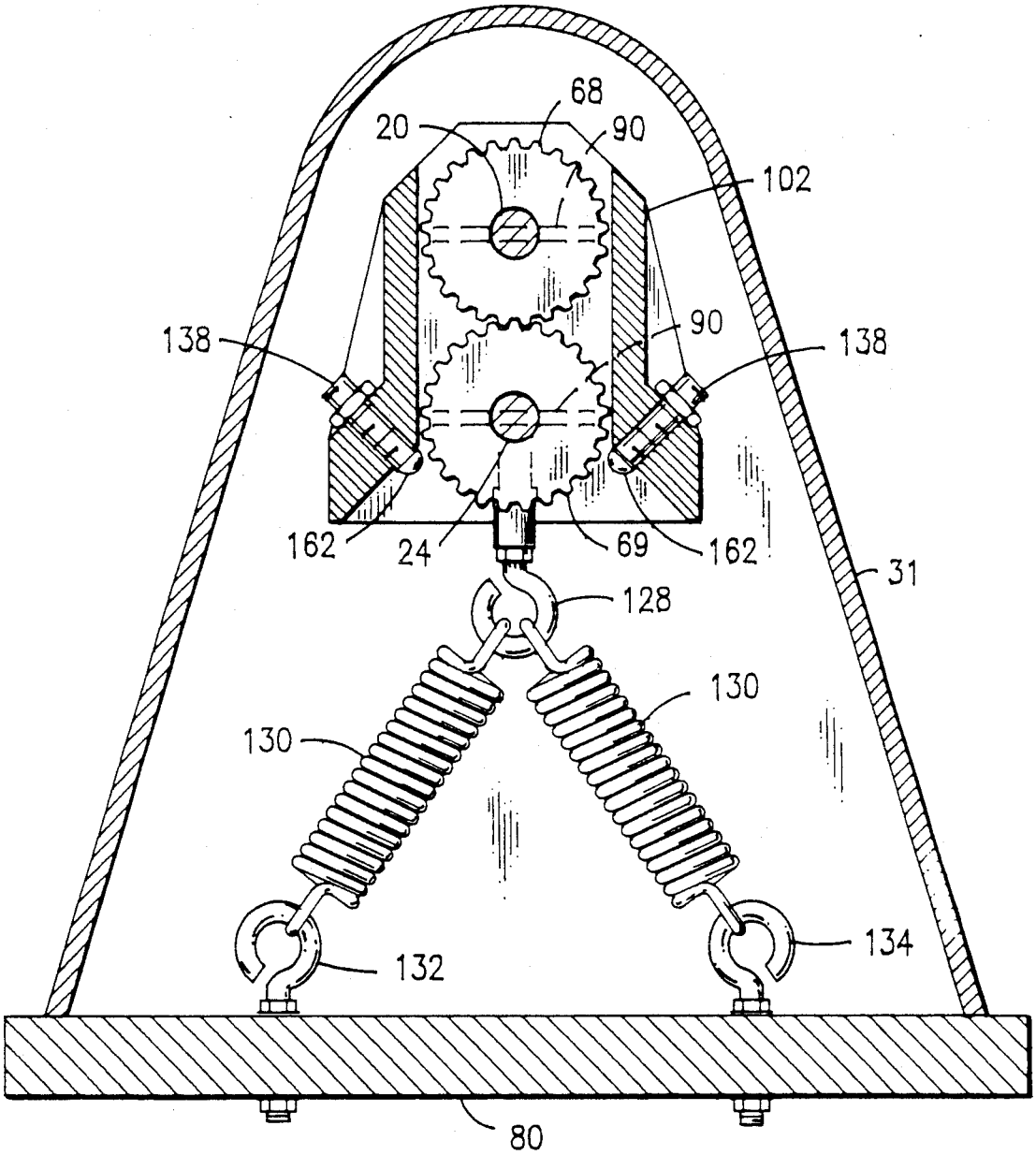
FIG. 5 is a section of a front elevational view showing the transmission assembly and its housing.
Figure 6:
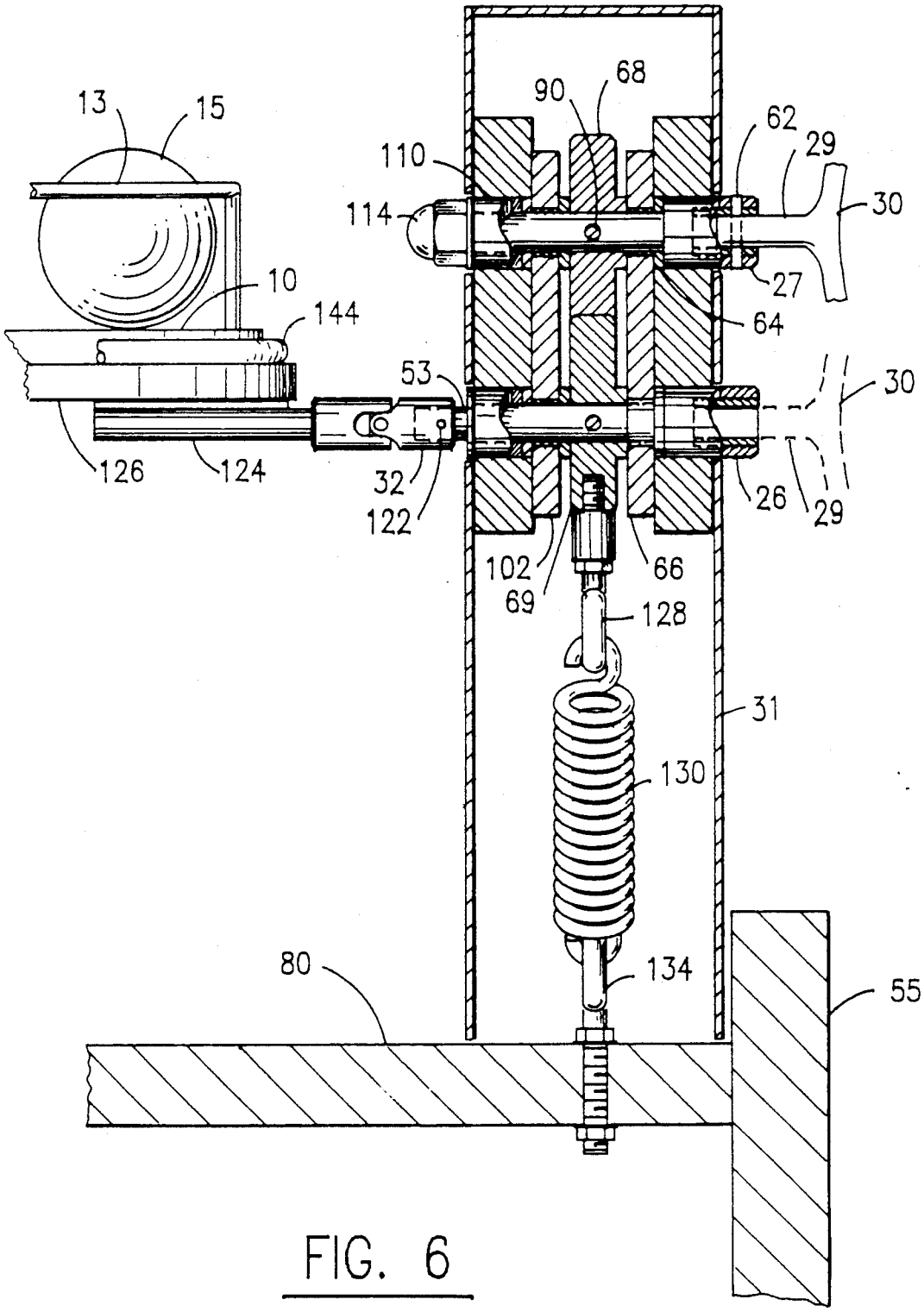
FIG. 6 is a longitudinal section view through the transmission housing.

A threaded eye hook 128 is screwed by its threaded end into the bottom of gear 69 as seen in FIGS. 5 and 6. The other end of the eye hook engages a pair of springs 130 which are engaged to separate eye hooks 132 and 134 bolted to the base member 80 joined to panels 55, 56 and 57.

As see in FIG. 9, an adjustable limiter device 138 is inserted into a hole 140 in the side portion of rear panel 102. Threads 142 on device 138 allow it to be adjusted to control its penetration through the side portion of rear panel 102 to act as a stop on gear 69. The end of limiter device 138 has a rubber tip 162 to prevent damage to gear 69.

Optionally, lights 144 can be attached along the periphery of curved path 10 to make the game more attractive in a night environment. In addition, a coin operating device as seen in FIG. 10 can be added. This device has a solenoid 146 that is activated by a dropping coin. The solenoid causes arm 148 to lift plate 150 and allow a ball 15 to pass to the player. A spring 152 retains the plate 150 in a locked position by holding one end 154 of plate 150. The plate pivots at point 156 when the arm 148 overcomes the pressure from spring 152. A stopper pin 158 prevent plates 150 from being pulled too far by spring 152.

Figure 3:
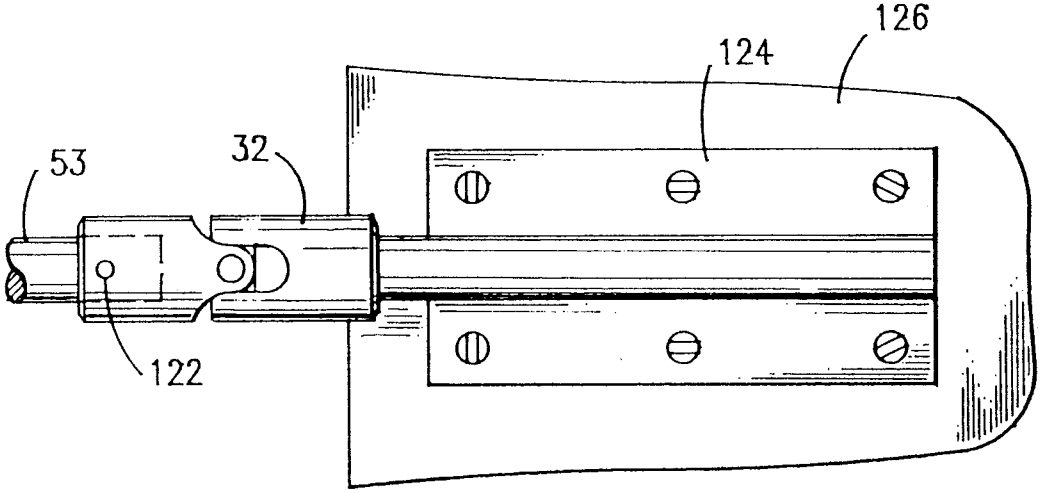
FIG. 3 is a bottom plan view of the steering mechanism subassembly.

FIG. 3 depicts the axle rod 53 as it is connected to the beginning portion of the curved zig-zag path 10. As depicted, it can be seen that the universal joint 32 is used to permit tilting of table 10.

Figure 4:
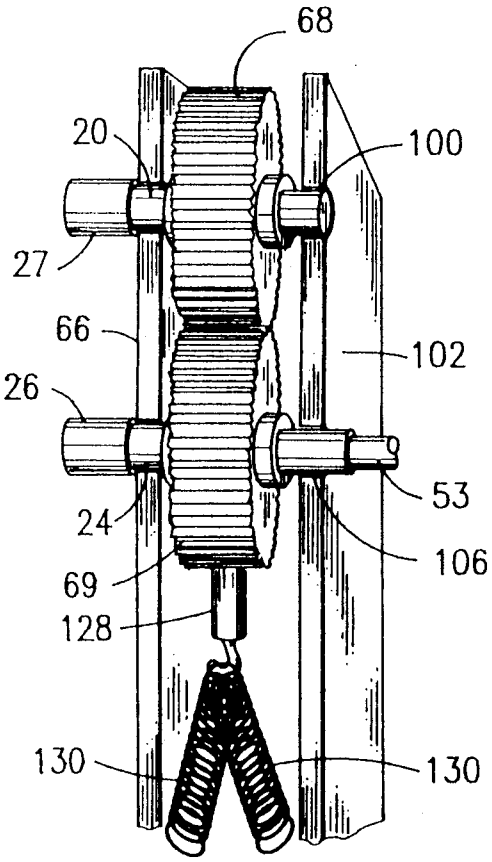
FIG. 4 is a side elevational view of the transmission gearing.

FIG. 4 is a cut-out view showing how two gears 68 and 69 are built into the steering wheel mount 31 in order to translate the rotation of the steering wheel to the axle 53 of the path. With two gears (one connected to the steering wheel translating rotation to the axle) the steering wheel rotation will be opposite that of the axle 53. Three gears in series (not depicted) would result in the same direction of rotation. Additionally, the gears could be made of different sizes in order to require more or less steering wheel rotation in order to achieve a given degree of path rotation. It finally should be noted that the steering control means could be in direct axle connection with the path axle (such as with the universal joint of FIG. 3) and no gears used at all.

A micro switch 160 as shown in FIG. 2 can be mounted on bottom surface 126 near objective 12 to indicate when a ball 15 has dropped into the objective 12. This switch 160 can activate a digital musical recording, a light or bell.

Modification and variation can be made to the disclosed embodiments without departing from the subject and spirit of the invention as defined in the following claims. Such modifications and variations, as included within the scope of these claims, are meant to be considered part of the invention as described.

Having thus described the invention what is claimed and desired to be secured by Letters Patent is:

1. A tiltable table apparatus for a ball rolling game comprising a bottom panel joining a pair of side panels, a front panel and a back panel, a table supporting means attached at a bottom end to the bottom panel and at a top end pivotally to a planar tiltable table, the tiltable table having an elongated zig-zag pattern containing a single track for a ball, an upper portion of the track having side support means for preventing the ball from leaving the track, and a lower portion of the track being devoid of side support means so that the ball can fall from the track to the bottom panel if the table is improperly controlled by a game player, an object target located in the lower portion of the track, the table being partially rotated about a central longitudinal axis by manipulation of a control means by a game player, the table having a downward slope from its upper portion to its lower portion. and the control means attached to a connecting means engaged to the table.

2. A tiltable table apparatus according to claim 1, wherein the table supporting means is an upwardly projecting strut engaged at an upper end to a pivotal bracket attached to a lower surface of the tiltable table.

3. A tiltable table apparatus according to claim 1 wherein the side support means for the upper portion of the track is a rail along each side edge of the track.

4. A tiltable table apparatus according to claim 1 wherein the object target is a hole in the table of sufficient diameter to accommodate the ball.

5. A tiltable table apparatus according to claim 1 wherein the control means is selected from the group consisting of a wheel and a lever.

6. A tiltable table apparatus according to claim 5 wherein the control means is attached to a first shaft axially attached to a second shaft engaged to a universal joint, the universal joint attached by a plate to a lower surface of the tiltable table located under the upper portion of the table.

7. A tiltable table apparatus according to claim 6 wherein the control means optionally engages through a shaft to a lower or upper gear, the lower gear being supported under tension by a pair of springs attached to the bottom panel.

8. A tiltable table apparatus for a ball rolling game comprising a bottom panel joining a pair of side panels, a front panel and a back panel, a tiltable table having an elongated serpentine track for a ball, the track spaced above the bottom panel, the track having an upper portion with a side support structure for preventing the ball from leaving the track, and a lower portion of the track having an object target for receipt of the ball, the track having a downward slope from the upper portion to the object target, the table being partially rotated about a central longitudinal axis through manipulation of a hand control element by a game player, the upper portion of the table being attached by a connecting element to the control element and the lower portion of the table being supported by a strut pivotally attached at an upper end to an underside of the table and at another end to the bottom panel.

9. The tiltable table apparatus according to claim 8 wherein an array of lights is attached along an exterior edge of the table.

10. The tiltable table apparatus according to claim 8 wherein the object target contains a relay switch to activate a digital musical recording, light or bell when the ball enters the object target.

11. The tiltable table apparatus according to claim 8 wherein the bottom panel slopes downwardly from the back to the front to allow a ball to roll to the front panel when it leaves the table.

12. The tiltable table apparatus according to claim 8 wherein a ball release mechanism activated by a metal coin or token releases a ball to the upper portion of the track.

13. An amusement park game testing the hand-eye coordination skills of a player, the game comprising;

a single planar path for a rolling ball, said path further defining a series of zig-zag curves about a central axis and being tilted so as to have an upper point of beginning on one end and a lower objective point on the other end;

said planar path being further adapted with a side support at an upper portion of the path the upper portion of the path being supported from below to facilitate the partial rotation of said planar path in either direction about said central axis and to support the weight of said path about said central axis;

said planar path being further adapted with a control means near said upper point of beginning in order to permit a player to control the rotation of said path; and a target at said objective point for receiving said rolling ball.

14. The game according to claim 13 wherein the control means further comprises a steering wheel in axial, rotational communication with the planar path central axis through a rotational transmission system.

15. The game according to claim 14 wherein the rotational transmission system further comprises one or more adjustable gears to set either the ratio or direction of rotation between the planar path and the steering wheel.

16. The game according to claim 13 wherein the target is a hole at the objective point, the hole sufficiently wide in diameter to receive the ball.

17. An amusement park game apparatus testing the hand-eye coordination skills of a player, the game apparatus having a game control elements comprising, an extended longitudinal planar path for a rolling ball, the path further defining a series of zig-zag curves about a central axis the planar path being tilted so as to have an upper point of beginning and a lower objective point;

the planar path being further adapted with a support at some point along the path to facilitate the partial rotation of the planar path in either direction about the central axis and to support the weight of the path;

the planar path being further adapted with a control means near the upper point of beginning in order to permit a player to control the rotation of the path; and a target at the objective point for receiving the rolling ball; and the game housing having a a mounting frame supporting the planar path within the frame, control elements at a front portion, and enclosing the planar path without obstructing the observation of the planar path from a player.

18. The game according to claim 17 wherein the mounting frame further comprises;

a front, two sides, and rear upright panels defining a rectangular cross-section;

a lower interior panel connecting all the upright panels and tilted at a slope so as to facilitate the rolling of a ball from any point on the interior panel to a designated point adjacent to the upright front panel;

the upright front panel being further adapted near its top with a mounting apparatus for control elements;

the lower interior panel being further adapted to support and receive a pivotal support for the planar path; and the mounting frame being constructed with dimensions suitable to house the planar path point of beginning near the front panel, the objective point near the rear panel and the extended longitudinal length of planar path between the side panels.

19. The game according to claim 18 wherein the front panel is further adapted with a releasable gate to permit a ball to be retrieved from a point through the front panel and the lower interior panel is adapted with one or more sloping surfaces so that a ball falling upon the lower interior panel will roll to the gate.

20. The game according to claim 19 wherein the releasable gate is in control communication with a coin activation device.

* * * * *